US006973696B1

(12) United States Patent
Koumarianos

(10) Patent No.: US 6,973,696 B1
(45) Date of Patent: Dec. 13, 2005

(54) MULTI-ROLLER APPLICATOR FOR PAINTING

(76) Inventor: Angelo Koumarianos, 1845 Forough Cir., Port Orange, FL (US) 32129

( * ) Notice: Subject to any disclaimer, the term of this patent is extended or adjusted under 35 U.S.C. 154(b) by 0 days.

(21) Appl. No.: 10/871,585

(22) Filed: Jun. 21, 2004

(51) Int. Cl.[7] ..... B05C 17/02
(52) U.S. Cl. ..... 15/230.11; 492/13; 492/19
(58) Field of Search ..... 15/230.11; 492/13, 492/19; D4/122, 123

(56) References Cited

U.S. PATENT DOCUMENTS 3,130,435 A * 4/1964 Smith ..... 15/230.11
3,263,260 A * 8/1966 Filler ..... 15/230.11
3,409,929 A * 11/1968 Sandor ..... 15/248.2
3,638,271 A * 2/1972 Pharris et al. ..... 15/230.11
3,649,986 A * 3/1972 Dahlund ..... 15/230.11
4,000,537 A * 1/1977 Woo ..... 15/230.11
4,320,553 A * 3/1982 Charles ..... 15/230.11

FOREIGN PATENT DOCUMENTS

JP 51-53543 * 5/1976
JP 9-271711 * 10/1997
JP 10-290951 * 11/1998

* cited by examiner

*Primary Examiner*—Mark Spisich
(74) *Attorney, Agent, or Firm*—Clifford G. Frayne

(57) ABSTRACT

A multi-roller applicator for the application of paint having a handle member and a frame member, the frame member having secured thereto in parallel relationship, a pair of spaced apart axles for the receipt of a frame core member and paint absorbing sleeve member rotationally mounted thereon for the application of paint.

6 Claims, 5 Drawing Sheets

MULTI-ROLLER APPLICATOR FOR PAINTING

BACKGROUND OF THE INVENTION

1. Field of the Invention

The present invention relates to painting and in particular to applicators such as paint rollers, and more particularly to a multi-roller paint applicator.

2. Description of the Prior Art

The application of paint is accomplished normally in one of three ways. For large, uninterrupted areas, paint is normally applied by spraying. For small areas, or detail work such as around door frames and window frames, a paint brush is usually employed. For larger areas of walls or ceilings which have interrupted areas, the paint is normally applied with a paint roller which allows the user to cover a greater quantity of area in less time.

Present paint rollers are normally of one piece construction and fabricated from an elongate metal rod member. The metal rod is formed into a straight handle end which is then bent at an angle generally perpendicular to handle and then rebent to define a length which is parallel to the handle and rebent a third time to form the roller support portion which is perpendicular to the handle end and which would normally be bisected by the handle end if the handle end were extended beyond the first right angle. The roller support portion of the metal rod slidably mechanically receives the paint roller and the internal frame upon which the paint roller is mounted. The paint roller and frame rotate freely on the rod portion. The roller is constructed of an outer layer of paint absorbing material and depending upon the surface which it is going to be used to cover, the paint roller is normally characterized as a rough or a finish roller.

The paint is normally poured into a receptacle having a tilted base which allows the user to via the handle end of the paint roller to place the roller into a quantity of paint and rotate the roller on the angled surface so that sufficient paint is absorbed on the outer surface of the roller. The user then contacts the roller with the surface to be painted and with a back and forth, or up and down motion causes the roller to rotate applying paint to the surface.

The handle end of the roller can vary in length depending on the type of painting required. For high walls or for ceilings, the handle end may be several feet long to allow the user to reach the area to be painted without having to use an elevation means. For a standard height wall, the handle portion may average approximately one foot.

Depending upon the surface to be painted, the user may have to apply several coats of paint. This could require two coats with the same type of roller or a first coat with a rough roller followed by a second coat with a finish roller.

While the application of paint by a paint roller is much quicker than if applied by a brush, the application by means of a paint roller may require the user to paint over the same surface area a plurality of times.

Applicant's invention provides for a multi-roller assembly in which two or more rollers are secured in parallel alignment on a single handle means. The rollers may rotate independently or the rollers may be juxtaposed such that the rotation of one roller causes the other roller to rotate by frictional engagement. This type of assembly allows the user to mount a combination of finish rollers or rough rollers on the applicator means depending upon the surface to be painted and allows for more paint to be applied in less time.

OBJECTS OF THE INVENTION

An object of the present invention is to provide for a novel paint applicator in which a plurality of paint rollers are mounted.

Another object of the present invention is to provide for a novel paint applicator in which a plurality of rollers simultaneously apply painting to the surface desired.

A still further object of the present invention is to provide for a novel paint applicator in which the plurality of rollers rotate independently.

A still further object of the present invention is to provide for a novel paint applicator wherein one of the plurality of rollers in rotation causes the rotation of the adjacent roller.

A still further object of the present invention is to provide for a novel paint applicator in which the user can combine rollers of the rough finish type and the fine finish type.

A still further object of the present invention is to provide for a novel paint applicator which allows more paint to be deposited on the surface to be painted than with a single roller.

A still further object of the present invention is to provide for a novel paint applicator which decreases the number of coats of paint that may have to be applied to the surface to be painted.

A still further object of the present invention is to provide for a novel paint applicator adaptor which allows the paint applicator having a single roller to be converted to a paint applicator having a plurality of rollers.

SUMMARY OF THE INVENTION

A multi-roller applicator for the application of paint having a handle member and a frame member, the frame member having secured thereto in parallel relationship, a pair of spaced apart axles for the receipt of a frame core member and paint absorbing sleeve member rotationally mounted thereon for the application of paint.

BRIEF DESCRIPTION OF THE DRAWINGS

These and other objects of the present invention will become apparent particularly when taken in light of the following illustrations wherein.

DETAILED DESCRIPTION OF THE INVENTION

Figure 1:
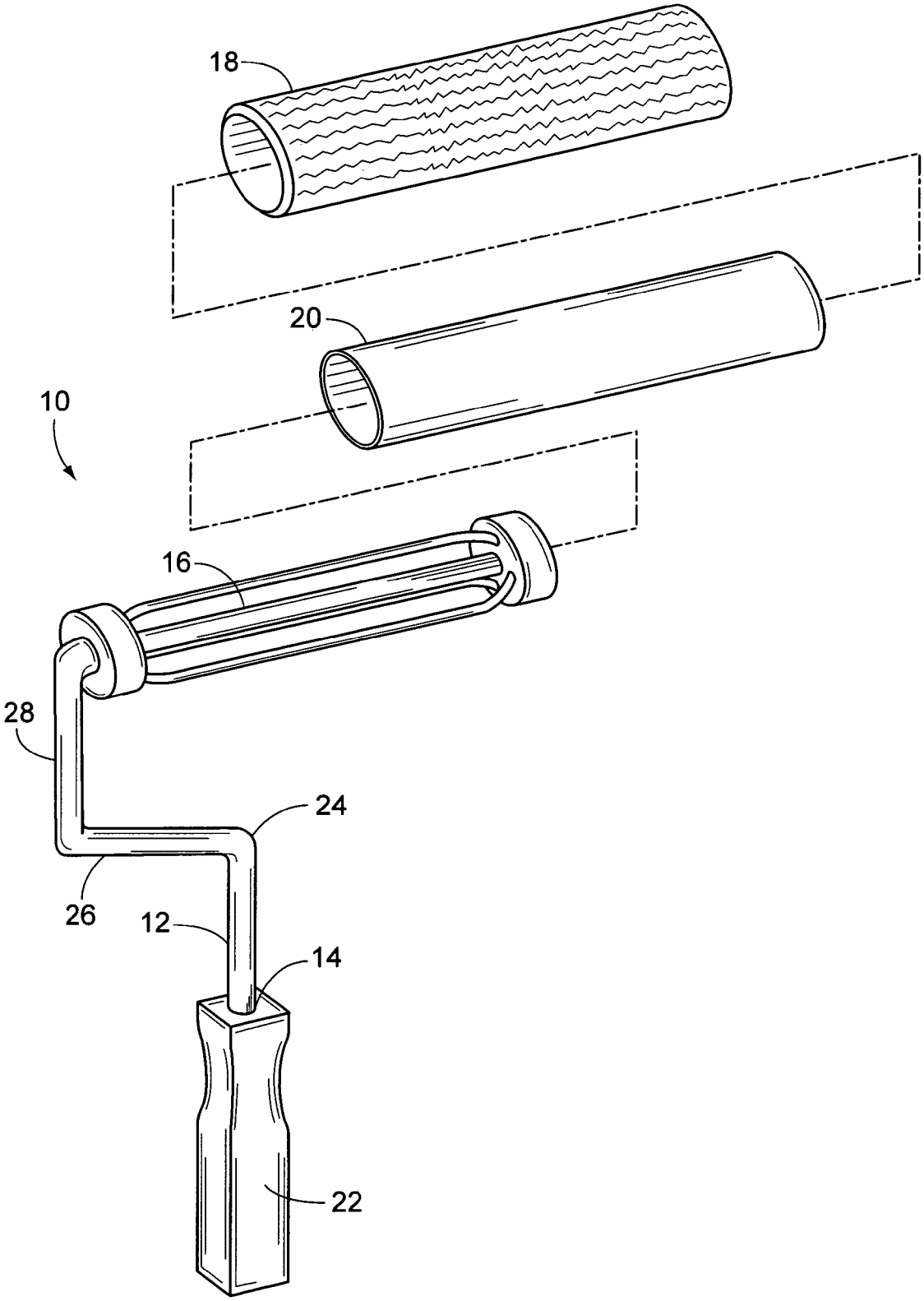
FIG. 1 PRIOR ART
FIG. 1 is a planar top view of the prior art.

FIG. 1 is a planar top view of a painting roller assembly of the prior art. Paint roller 10 consists of a rod member 12 which is bent and/or angled so as to serve both as a handle portion 14 and an axle 16 for a rotational paint sleeve 18 and frame or core member 20. The handle portion 14 of rod 12 is fitted with a frictional grip 22. The handle portion 14 of rod 12 is first bent or angled at 24 so as to form a right angle or an obtuse angle with handle portion 14 and is identified by segment 26. The rod member is then again bent or angled to form segment 28 which is substantially parallel to handle portion 14. Segment 28 is then bent at a 90 degree angle to form the axle portion 16 for support of frame or core member 20 and paint sleeve 18 the circumference of which is covered by a paint absorbing material such as felt, fleece or foam. As a general design, the extension of handle member 14 would bisect the axle member 16 thereby providing ease of use by the user.

Typically frame or core member 20 paint absorbing sleeve member 18 are in snap fit engagement on axle member 16 and can be slidably removed therefrom with the paint sleeve member 18 being separated from frame or core member 20 for ease of cleaning.

Figure 2:
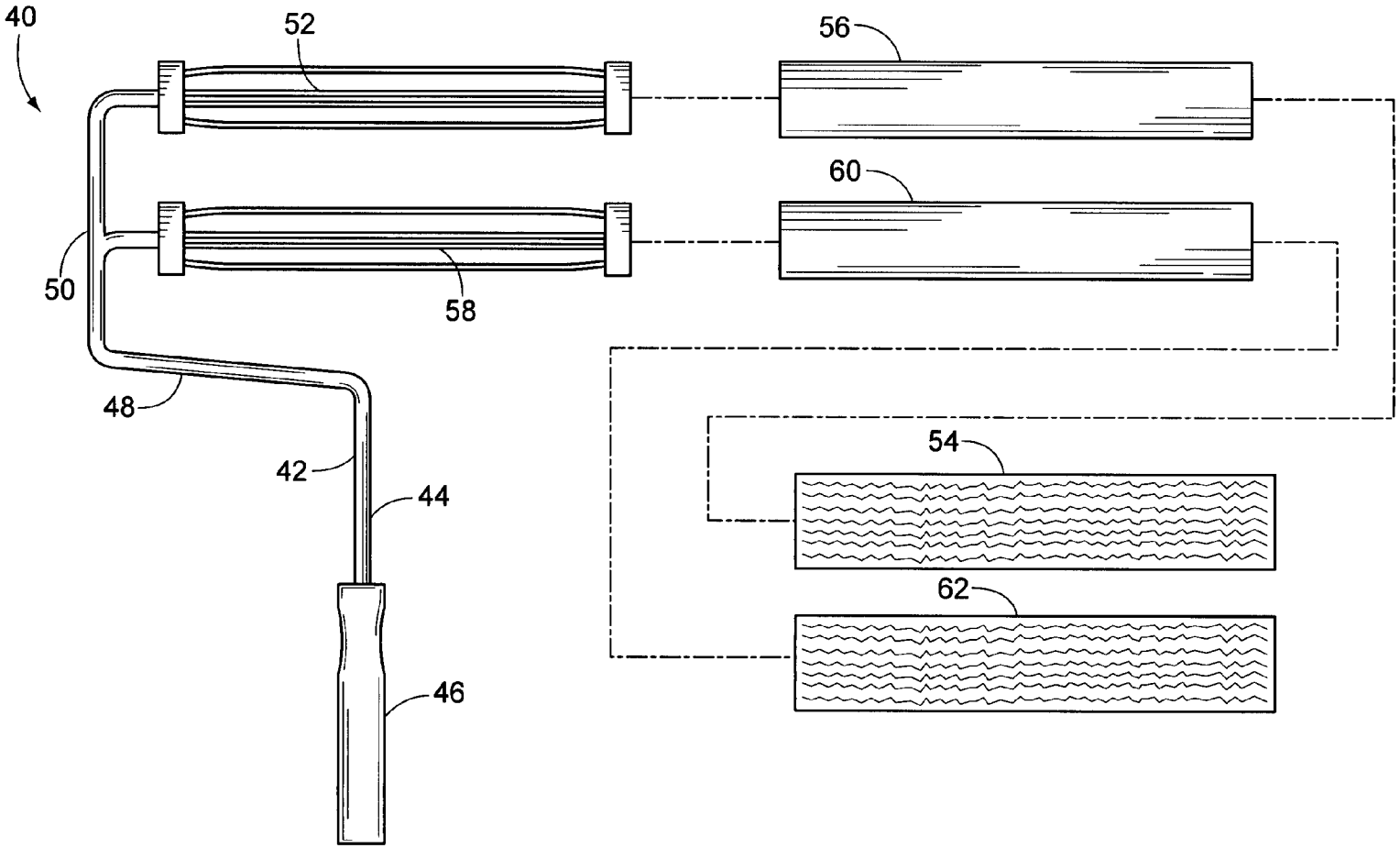
FIG. 2 is a planar top exploded view of the multi-roller paint applicator of the present invention.
Figure 3:
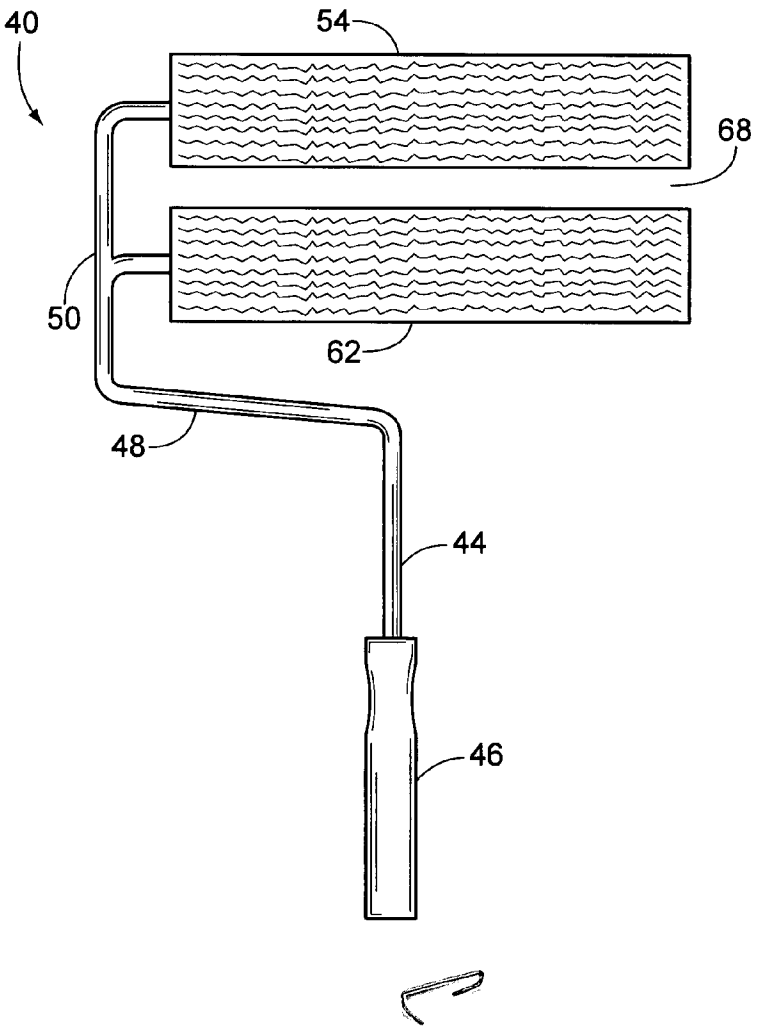
FIG. 3 is a planar top view of the multi-roller paint applicator of the present invention.
Figure 4:
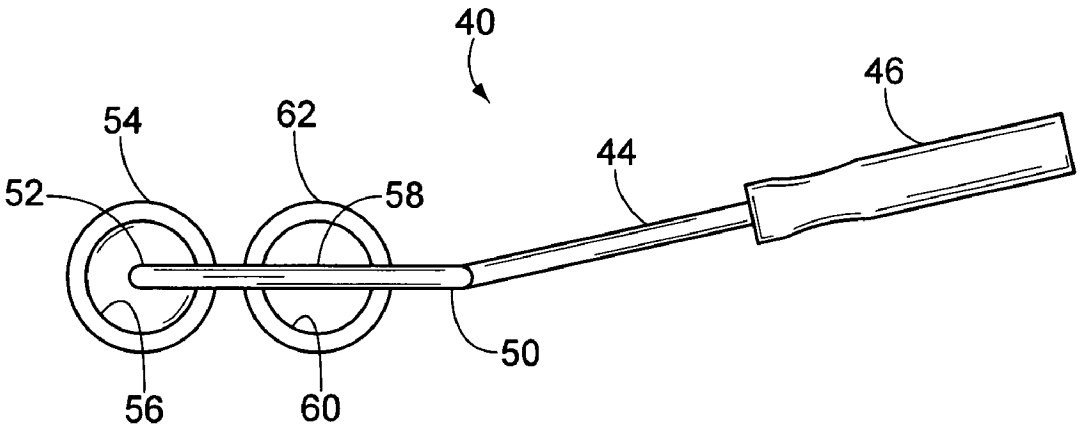
FIG. 4 is a side view of the multi-roller paint applicator of the present invention.

FIGS. 2, 3 and 4 are a planar top exploded view, top view, and side view of a multi-roller paint applicator of the present invention. Multi-roller paint applicator 40 is similar to that of the prior art in that it is formed of a rod member 42 forming a handle portion 44 having a grip member 46 secured thereto. Rod member 42 is bent or angled at the termination of the handle portion 44 to form a right angle or obtuse segment 48 and then bent or angled to form a segment 50 which is substantially parallel to handle portion 44. Segment 50 is then bent or angled at 90 degrees to form a first axle member 52 for receipt of a paint absorbing sleeve 54 and frame or core member 56. A second axle member 58 is secured to segment 50 by a weld if the rod member is of metal or in the molding process if the rod member is of a high impact plastic.

Second axle member 58 is for the receipt of a second frame or core member and second sleeve member 60 and 62 in parallel relationship with the first frame or core member 56 and first paint absorbing sleeve member 54. First and second frame members 56 and 60 and first and second roller members 54 and 62 are secured to the first and second axle means respectively by snap fit engagement with which allows for the rotation of the roller means.

Since there are two axle members and two paint absorbing roller members associated with the multi-roller paint applicator, the handle means and the first and second axle means are not suitable for positioning in the same plane since it is desirable that both rollers contact the painting surface simultaneously, a handle means in the same plane as the axle means would mean that the user's hand would most likely come in contact with the painting surface or the wet paint applied thereto during the painting process. Therefore, handle portion 44 of multi-paint roller 40 is formed at an obtuse angle with the plane in which the first axle member 52 and second axle member 58 are positioned.

In the embodiment illustrated in FIG. 2, first paint absorbing roller and the second paint absorbing roller could both be characterized as finishing rollers. They would be used for a smooth surface having a previously layer of paint applied thereto. Paint absorbing sleeves 54 and 62 of FIG. 2 would be positioned on first and second axles 52 and 58 and rotate independently of each other as they were drawn across the surface to be painted. As such, there would be a gap 68 between the rollers when affixed onto first and second axles 52 and 58.

In a further embodiment, first axle means 52 could be fitted with a rough point absorbing sleeve 54, which generally has a greater depth of paint absorbing material increasing its outer circumference in order to absorb more paint from the paint tray for application to the surface to be painted. A rough roller would be utilized on a pristine surface having no prior paint applied or to a slightly textured surface. The deeper pile allows for the application of paint into the exposed uneven surface. The rough point absorbent sleeve 54 could be coupled with a paint absorbing sleeve 62 affixed to second axle means 58 which would be characterized as a finishing roller so as to follow the rough roller and smooth the surface paint. In this configuration, a rough paint application roller is generally of greater circumference than a finishing roller.

The rough paint applying roller would rotate in one direction during the push stroke of applying the paint and in a reverse direction during the pull stroke in applying a coat of paint. Since it is in abutting contact with the finishing roller, the finishing roller would rotate in the opposite direction of the rough paint applying roller during the push and pull strokes.

Figure 5:
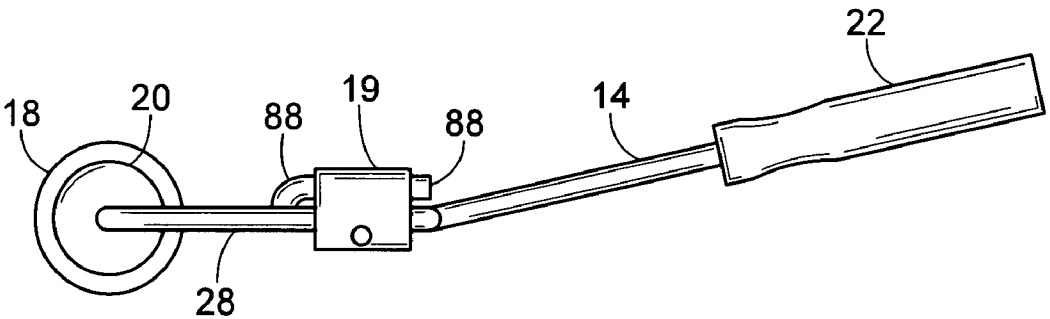
FIG. 5 is a side view of an adaptor for conversion of a single roller paint applicator to a multi-roller paint applicator.
Figure 7:
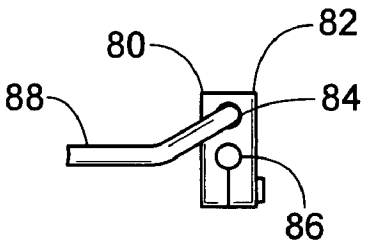
FIG. 7 is an end view of the adaptor of FIG. 5.
Figure 6:
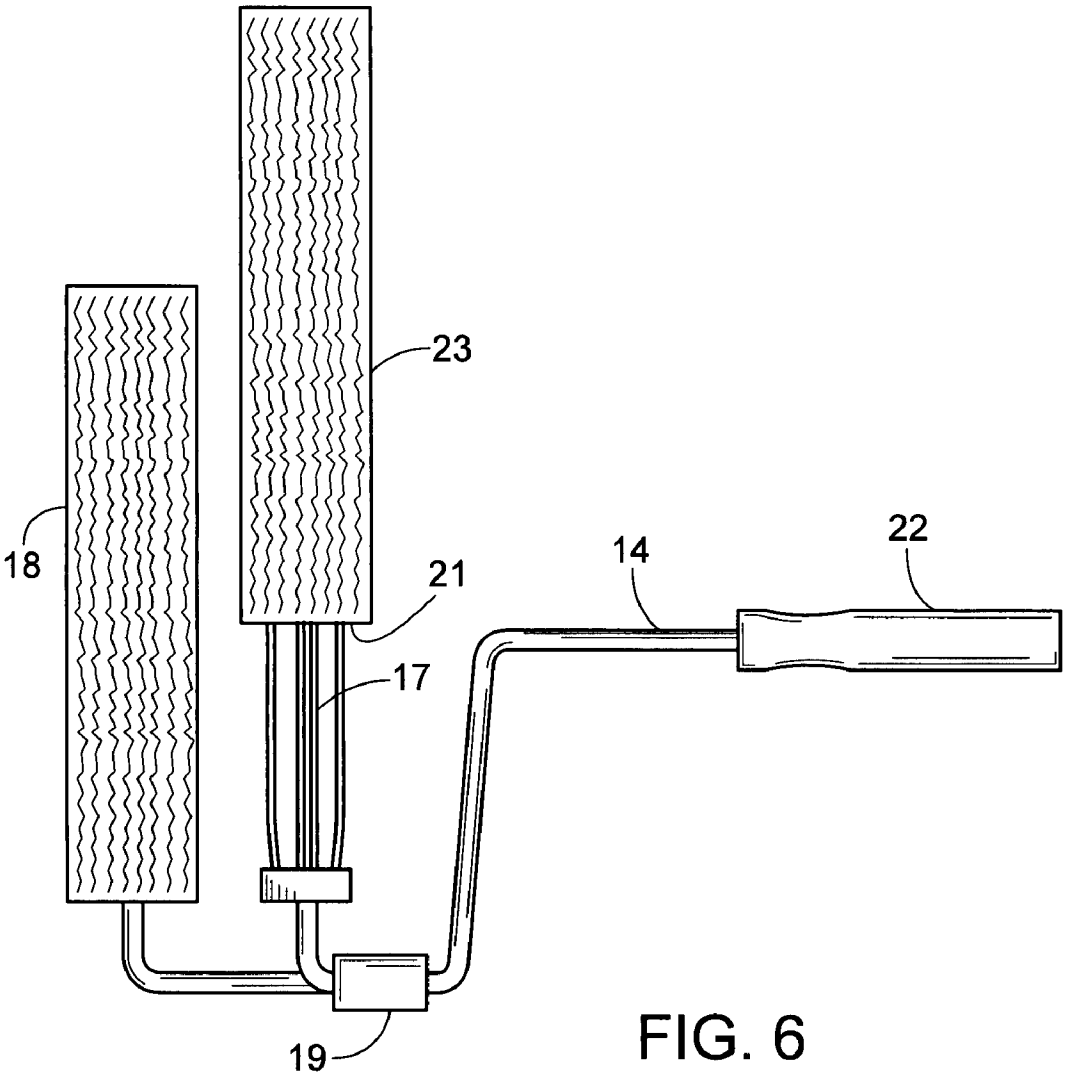
FIG. 6 is a top view of the adaptor of FIG. 5.

FIGS. 5, 6, and 7 illustrate an adaptor for conversion of a single roller paint applicator as illustrated in FIG. 1 into a multi-roller paint applicator. In this embodiment, the single roller paint applicator 10 has secured thereto in parallel alignment with its original axle means 16, a second axle means 17 which is fixedly secured to a mechanical fastening clip 19 which in turn is fixedly secured to segment 28 of rod member 12 such that the spacing between the original first axle member 16 and the second axle member 17 is sufficient for the positioning of a separate frame member 21 and paint absorbing sleeve 23 on second axle means 17 in parallel relationship to axle 16 for operation in accordance with the discussions concerning FIGS. 2, 3, and 4. In order to accommodate the two rollers in contact with the surface, the handle portion 14 could be bent so as to form an obtuse angle with the plane of the first and second axle members 16 and 17.

The clip member 19 would be of two piece construction having a first half 80 and a second half 82. When secured together, halves 80 and 82 would define two throughbores 84 and 86 running in parallel relationship for the length of the clip member 19. The upper throughbore would be for the receipt of a rod member 88 which would serve as the second axle means 17. The lower throughbore 86 would be for receipt of segment arm 28 of rod 12. Rod 88 which forms second axle means 17 would be secured in parallel relationship within clip 19 with segment 28 of rod 12. Upon exiting the clip, the rod member 88 turns away from and downwardly from segment 28 so as to be positioned in the same plane as axle 16. The two halves 80 and 82 of clip member 19 will be securable by threaded fasteners to maintain their orientation.

It will be recognized that the multi-roller paint applicator as described herein, is disclosed with a handle of relatively short length of approximately one foot for a typical paint applicator which would be utilized by an individual standing in front of the wall without the requirement of any additional elevational means. It will be recognized by those of ordinary skill in the art that the extension of the handle will allow for the user to paint elevated areas without the need for the user to require any elevation means and that such extension of the handle will not depart from the spirit and scope of the invention as disclosed. Still further, they will be recognized by those of ordinary skill in the art that a further extension of the handle and modification of the angle between the handle and the plane of the parallel axle means can be afforded so that an individual user may stand on the floor without the benefit of any elevational means and apply paint to an elevated ceiling.

While the present invention has been described with respect to the exemplary embodiments thereof, it will be recognized by those of ordinary skill in the art that many modifications or changes can be achieved without departing from the spirit and scope of the invention. Therefore it is manifestly intended that the invention be limited only by the scope of the claims and the equivalence thereof.

I claim:

1. A multi-roller applicator for the application of paint to a surface, said applicator comprising:

a support member, said support member having handle segment and an axle supporting segment parallel with said handle segment, said handle segment and said axle supporting segment joined by an intermediate segment;

a plurality of axle members in parallel spaced apart relationship extending from said axle supporting segment of said support member perpendicular to said handle segment of said support member, wherein one of said plurality of axle members is an extension of said support member and said remaining axle members are secured to said axle supporting segment; wherein said remaining axle members are secured by means of a friction clip on said axle supporting segment; wherein said friction clip is of two piece construction secured by threaded fasteners to define a first throughbore for engagement with said axle supporting segment and a second throughbore for engagement with said remaining axle member, said remaining axle member having a perpendicular finger formed on an end thereon for engagement in said respective throughbore;

a core frame member slidably receivable within a paint absorbing sleeve to form a paint roller, said paint roller removably mounted on each of said plurality of axle members, said paint rollers in rotational relationship with each other on said axle members.

2. The multi-roller applicator for the application of paint in accordance with claim 1 wherein said plurality of axle members number 3.

3. The multi-roller applicator for the application of paint in accordance with claim 1 wherein said plurality of axle members number 2.

4. The multi-roller applicator for the application of paint in accordance with claim 1 wherein said handle segment is angled in relationship to a plane defined by said plurality of axle members.

5. The multi-roller applicator for the application of paint in accordance with claim 1 wherein said spacing between said plurality of axle members is sufficient to accommodate a core frame member and paint absorbing sleeve of varying circumference.

6. The multi-roller applicator for the application of paint in accordance with claim 1 wherein said handle segment is provided with a grip member.

* * * * *